US005943022A

United States Patent [19]

Massey

[11] Patent Number: 5,943,022

[45] Date of Patent: Aug. 24, 1999

[54] PORTABLE COMMUNICATION DEVICE INCLUDING LOOP ANTENNA

[75] Inventor: Peter J. Massey, Broadfield Crawley, United Kingdom

[73] Assignee: U.S. Philips Corporation, New York, N.Y.

[21] Appl. No.: 08/757,528

[22] Filed: Nov. 27, 1996

[30] Foreign Application Priority Data

Nov. 29, 1995 [GB] United Kingdom ..... 9524442

[51] Int. Cl.[6] ..... H01Q 11/12

[52] U.S. Cl. ..... 343/744; 343/702; 343/866; 29/600

[58] Field of Search ..... 343/702, 741, 343/744, 748, 718, 866, 867; 29/600

[56] References Cited

U.S. PATENT DOCUMENTS

| | | | |
|---|---|---|---|
| 2,166,750 | 2/1939 | Carter | 343/744 |
| 4,547,776 | 10/1985 | Bolt, Jr. et al. | 343/741 |
| 4,922,260 | 5/1990 | Gaskill et al. | 343/718 |
| 5,499,398 | 3/1996 | Kudoh | 343/744 |
| 5,627,552 | 5/1997 | Farrar et al. | 343/741 |

*Primary Examiner*—Don Wong
*Assistant Examiner*—Tan Ho
*Attorney, Agent, or Firm*—Jack D. Slobod

[57] ABSTRACT

A portable communication device is described comprising a loop antenna. The loop antenna consists of a dielectric strip with overlapping conductive plates on both sides, so that capacitors are formed, which are arranged in series with one another. In order to have a good efficiency and at the same time a high insensitivity for detuning due to capacitive coupling of the antenna to the body of the user, the number of capacitors should be less than five an the capacitors should be arranged widely spaced over the loop.

10 Claims, 1 Drawing Sheet

PORTABLE COMMUNICATION DEVICE INCLUDING LOOP ANTENNA

BACKGROUND OF THE INVENTION

1. Field of the Invention

The invention relates to a portable communication device comprising a loop antenna, the loop antenna comprising a dielectric strip and a plurality of capacitor plates disposed on both sides of the dielectric strip to form discrete capacitors, the capacitors being connected to one another in series. Such a portable communication device is for example a pager or a hand set for mobile telephony. The invention also relates to a loop antenna and to a method of manufacturing such a loop antenna.

2. Description of the Related Art

A portable communication device according to the preamble is known from the U.S. Pat. No. 4,922,260. In this patent a watch is described having an antenna embedded in its wrist band. The antenna comprises a large number of capacitors formed by overlapping capacitor plates on both sides of the dielectric strip. However, no indication whatsoever is given about the dimensions of the antenna and the capacitors, which are necessary to obtain an antenna which has an acceptable efficiency, while at the same time being hardly susceptible to detuning due to the capacitance between the antenna and the body of a user carrying the portable communication device.

OBJECT AND SUMMARY OF THE INVENTION

It is an object of the present invention to provide a portable communication device according to the preamble, which has an acceptable efficiency and which is not easily detuned due to the proximity of a user. Thereto a portable communication device according to the preamble is characterized in that the number of capacitors is equal to or smaller than five and in that the capacitors around the loop are widely spaced. From measurements carried out by the Applicant it appeared that when the number of capacitors is five or smaller a reasonable efficiency is obtained. By arranging the capacitors widely spaced over the loop, it is achieved that at the same time the susceptibility to detuning due to the user's body is low.

An embodiment of a portable communication device according to the invention is characterized in that the capacitor plates have a width/thickness ratio greater than 20:1. In this way a high efficiency is obtained.

A further embodiment of a portable communication device according to the invention is characterized in that a width of the conductor plates is equal to or greater than the lesser distance across the loop. The lesser distance across the loop is determined by the space available within the portable communication device, which in practice is constrained. By making the width of the capacitor plates equal to or greater than the lesser distance, the best efficiency is obtained in the available space.

A further embodiment of a portable communication device according to the invention is characterized in that the capacitors have a value equal to or greater than 5 pF. This value greatly exceeds the value of the capacitance between the loop antenna and a user of the portable communication device. So, a great insensibility to detuning due to user proximity is obtained.

The invention further relates to a loop antenna comprising a dielectric strip and a plurality of capacitor plates disposed on both sides of the dielectric strip to form discrete capacitors, the capacitors being connected to one another in series, characterized in that the number of capacitors is equal to or smaller than five and in that the capacitors around the loop are widely spaced, as well as a method of manufacturing a loop antenna in a simple and cheap way.

BRIEF DESCRIPTION OF THE DRAWING

The invention will now be further explained with reference to a drawing, in which.

DETAILED DESCRIPTION OF THE PREFERRED EMBODIMENTS

Figure 1:
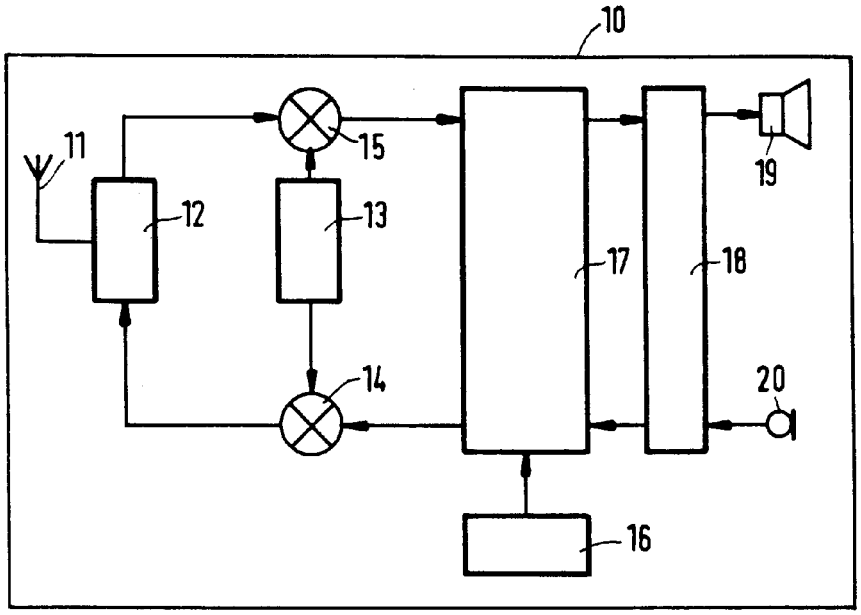
FIG. 1 shows a block diagram of a portable communication device.

FIG. 1 shows in a general way a block diagram of a portable communication device 10, such as for example a hand set for mobile telephony. The portable communication device comprises an antenna 11, a duplexer 12, a frequency synthesizer 13, a first and a second mixer 14,15, a controller 16, a baseband processing unit 17, a codec 18, a loudspeaker 19 and a microphone 20. Such portable communication devices are widely known. They work at frequencies in the range between several tens of MHz and a few GHz, depending on the system for which they are meant (GSM, DECT etc.). The duplexer 12 controls if a signal is transmitted or received. The first mixer 14 mixes a high frequency wave, generated by the frequency synthesizer 13 with a baseband signal in order to obtain a high frequency signal to be transmitted. The second mixer 15 mixes a high frequency wave with a received high frequency signal in order to obtain a baseband signal. The baseband processing part 16 and the codec 17 are arranged for processing and coding of the analog signal coming in via the microphone 20 so as to obtain a baseband signal (digital) and decoding the baseband signal so as to obtain an analog signal, to be reproduced by the loudspeaker 19. In case that the portable communication device is a pager, a much simpler block diagram is obtained in which the baseband processing part 16, the codec 17, the microphone 20 and the first mixer 14 are left away.

Figure 2:
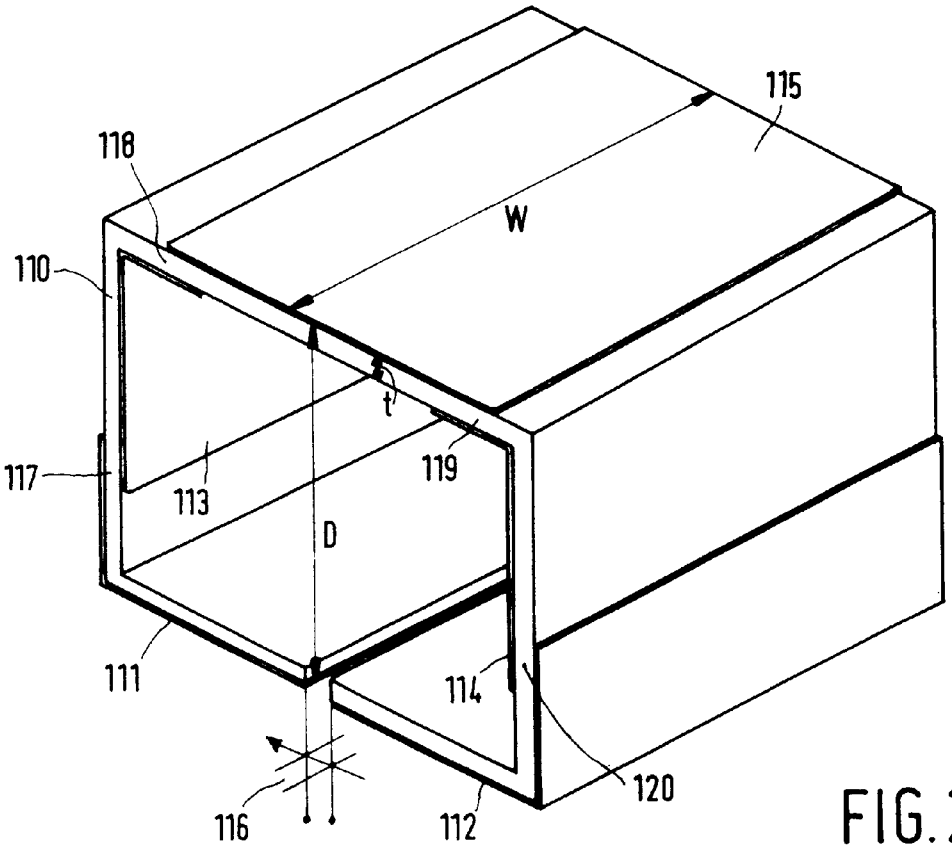
FIG. 2 shows a loop antenna according to the invention in a three-dimensional view.

In modern portable communication devices the antenna often is a miniature antenna fit within the housing of the portable communication device. In the present invention this antenna is a small loop antenna as shown in FIG. 2. The loop antenna consists of a dielectric strip 110. The dielectric strip may be a PTFE-sheet with a thickness of a few tenths of a millimetre. On both sides of the strip overlapping conductive plates 111,112,113,114,115 of for example copper are arranged. Due to the overlapping parts of the plate capacitors 117,118,119,120 are obtained, which are arranged in series with one another. The antenna comprises furthermore a discrete tuning capacitor 116 arranged between its extreme points. Due to the presence of the capacitors the antenna is insensitive to detuning due to capacitive coupling to a user's body. Especially when the value of the capacitors is made clearly higher than the highest possible value of the capacitive coupling, the insensitivity to decoupling is high. A value for the capacitors, giving very good results is 5 pF or higher but also lower values lead to acceptable results. Every capacitor has an intrinsic resistive part. This part is responsible for losses in the antenna. Therefore in order to obtain a good efficiency and at the same time a high insensitivity for user proximity detuning, the number of capacitors should be equal or less than five. In the antenna shown in FIG. 2, four capacitors are present. However, very good results can be obtained with only two capacitors arranged in the loop. The capacitors should be widely spaced over the loop.

In order to get a high efficiency the antenna is best designed to meet the following characteristics. The antenna width W should be made as large as the available space admits, while the thickness t of the strip should be kept small. In order to keep the insensitivity to proximity detuning high the lesser width of the antenna D should be kept relatively small. Good results will be obtained with antennas having a width/thickness-ratio of the capacitor plates of at least 20:1 and a width W which is equal to or greater than the lesser distance of the loop.

The antenna shown in FIG. 2 has a rectangular shape. This is because in practice in portable communication devices, the space available for the antenna, usually has a rectangular shape, also. So, in this way the available space is used optimally.

A very easy and cheap way to manufacture an antenna having capacitor plates around a dielectric strip comprises the following steps:

Applying conductor sheets to both sides of a dielectric sheet. This can be done by rolling the conductors (usually copper) to the dielectric sheet or by electrodepositing them. The practical difference is that a rolled conductor is slightly more conductive, while a electrodeposited conductor adheres slightly better to the dielectric sheet.

Etching the conductor sheets such that a pattern of capacitor plates is obtained. This can be done using standard photoresistors to protect the conductor sheets where they are to remain.

Cutting a strip from the dielectric sheet.

Bending the strip such that a loop is obtained.

Alternatively, the conductors can be directly applied to the dielectric sheet in the form of strips, such that the pattern of capacitor plates is obtained. The width of these strips is the same of the width of the loop antenna to be obtained. After applying the strips to the dielectric, the strip of dielectric on which the conductor strips are attached is cut from the dielectric sheet. In this way the etching step can be saved.

I claim:

1. Portable communication device comprising a loop antenna, the loop antenna comprising a dielectric strip and a plurality of capacitor plates disposed on both sides of the dielectric strip to form discrete capacitors, the capacitors being connected to one another in series, characterized in that the number of capacitors is equal to or smaller than five and in that the capacitors around the loop are widely spaced, and in that the loop antenna is manufactured by the following steps:

applying conductor sheets to both sides of a dielectric sheet;

etching the conductor sheets such that a pattern of capacitor plates is obtained;

cutting a strip from the dielectric sheet; and bending the strip such that a loop is obtained.

2. Portable communication device as claimed in claim 1, characterized in that the capacitor plates have a width/thickness ratio greater than 20:1.

3. Portable communication device as claimed in claim 1, characterized in that a width of the conductor plates is equal to or greater than the lesser distance across the loop.

4. Portable communication device as claimed in claim 1, characterized in that the capacitors have a value equal to or greater than 5 pF.

5. Portable communication device as claimed in claim 1, characterized in that said applying conductor strips to both sides of a dielectric sheet is such that a pattern of capacitor plates is obtained; and said cutting a strip of the dielectric sheet on which the conductor strips are attached is from the rest of the dielectric sheet.

6. Loop antenna comprising a dielectric strip and a plurality of capacitor plates disposed on both sides of the dielectric strip to form discrete capacitors, the capacitors being connected to one another in series, characterized in that the number of capacitors is equal to or smaller than five and in that the capacitors around the loop are widely spaced, and in that the loop antenna is manufactured by the following steps:

applying conductor sheets to both sides of a dielectric sheet;

etching the conductor sheets such that a pattern of capacitor plates is obtained;

cutting a strip from the dielectric sheet; and bending the strip such that a loop is obtained.

7. Loop antenna as claimed in claim 6, characterized in that said applying conductor strips to both sides of a dielectric sheet is such that a pattern of capacitor plates is obtained; and said cutting a strip of the dielectric sheet on which the conductor strips are attached is from the rest of the dielectric sheet.

8. Loop antenna as claimed in claim 6, characterized in that the capacitor plates have a width/thickness ratio greater than 20:1.

9. Loop antenna as claimed in claim 6, characterized in that a width of the conductor plates is equal to or greater than the lesser distance across the loop.

10. Loop antenna as claimed in claim 6, characterized in that the capacitors have a value equal to or greater than 5 pF.

* * * * *